United States Patent [19]

McCormick et al.

[11] 4,078,724

[45]. Mar. 14, 1978

[54] RAIL CLIP WITH DEFORMABLE ATTACHMENT LUGS

[76] Inventors: William C. McCormick, 1430 Lakewood Rd., Jacksonville, Fla. 32207; Robert S. Baker, 5679 Del Prado Ave., Tampa, Fla. 33617; Gilbert H. Pry, 1311 E. Calhoun St., Plant City, Fla. 33566

[21] Appl. No.: 731,044

[22] Filed: Oct. 8, 1976

[51] Int. Cl.[2] ..... E01B 9/32

[52] U.S. Cl. ..... 238/351; 238/295; 238/378

[58] Field of Search ..... 238/295, 298, 310, 314, 238/315, 318, 324, 338, 343, 351, 352, 353, 377, 378, 287, 84–89

[56] References Cited

U.S. PATENT DOCUMENTS

| | | | |
|---|---|---|---|
| 722,094 | 3/1903 | Ford | 238/343 |
| 807,313 | 12/1905 | Pelmulder | 238/377 |
| 864,311 | 8/1907 | Lancaster | 238/89 |
| 1,086,411 | 2/1914 | Spencer | 238/352 |
| 1,577,384 | 3/1926 | Stoye | 238/94 |
| 3,484,043 | 12/1969 | Borup et al. | 238/287 |
| 3,904,114 | 9/1975 | Kasuba | 238/315 |

FOREIGN PATENT DOCUMENTS

| | | | |
|---|---|---|---|
| 547,656 | 9/1956 | Italy | 238/343 |

*Primary Examiner*—John J. Love
*Assistant Examiner*—Carl Rowold
*Attorney, Agent, or Firm*—Mason, Fenwick & Lawrence

[57] ABSTRACT

A rail mounting assembly is disclosed including clip members which is some cases have formable portions for effecting engagement with a base plate to retain the clip member in position on a crosstie with the base plates on opposite sides of the rail being connected by an anchor means extending internally of the crosstie. Another aspect of the invention involves clip members and base plates having engageable serrated surfaces clamped together by a bolt received in a threaded anchor in a concrete crosstie so that loosening and subsequent tightening of the bolt permits the adjustment of the clip members with respect to the radial base flange and another embodiment in which a clip is held in position by a bolt in the anchor member in the crosstie with the clip having a coined surface canted at an angle to accommodate rail tilt and sawtooth serrations engaging the bolt head for preventing loosening of the bolt member.

8 Claims, 16 Drawing Figures

Fig-1
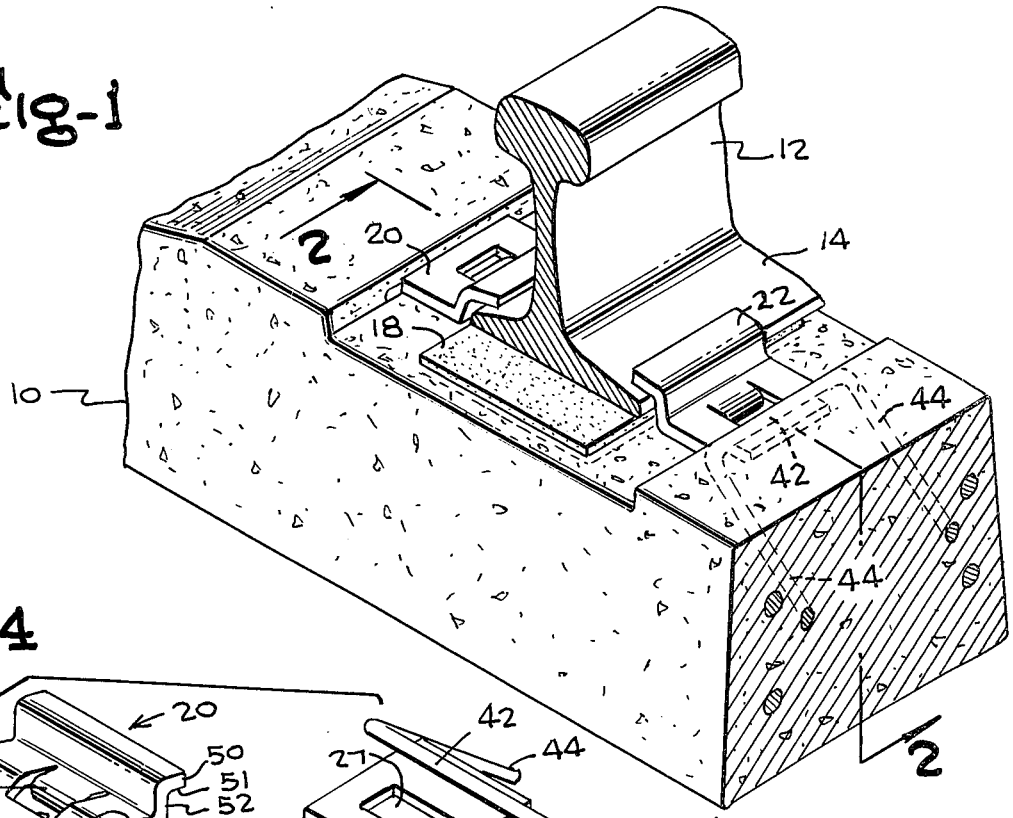
Fig-4
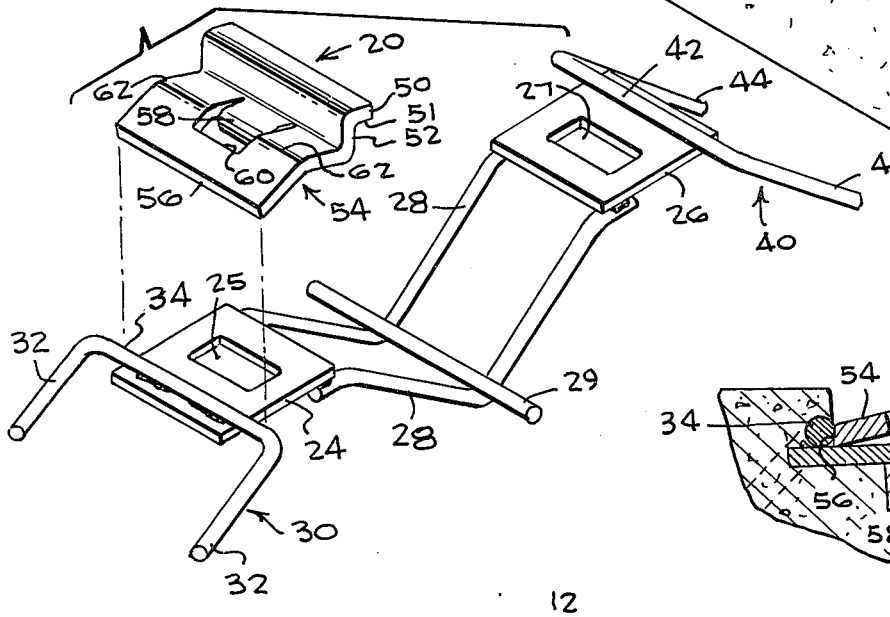
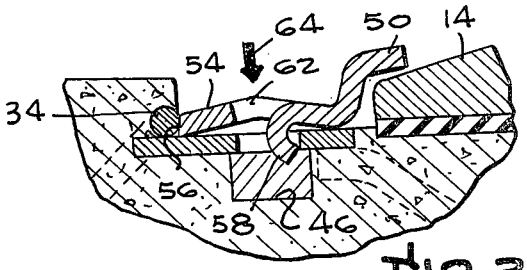
Fig-3
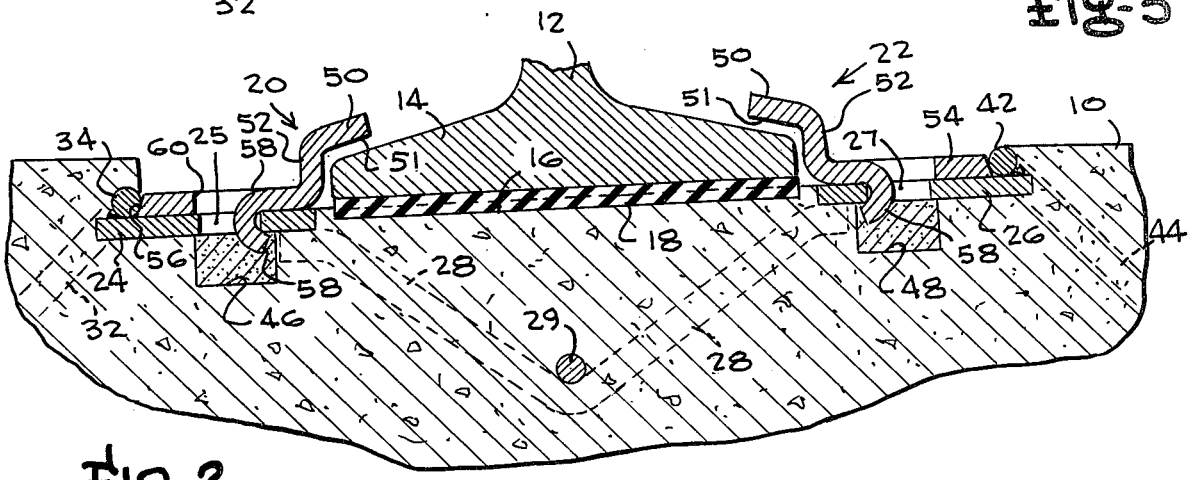
Fig-2

Fig-9-A
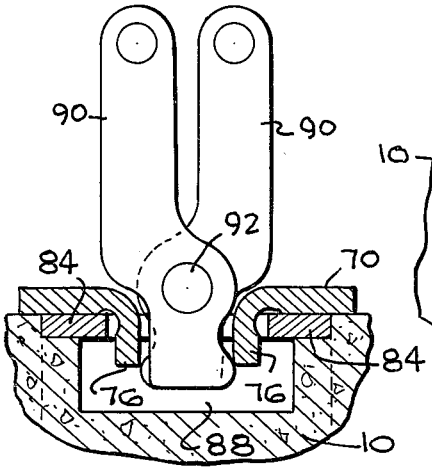
Fig-5
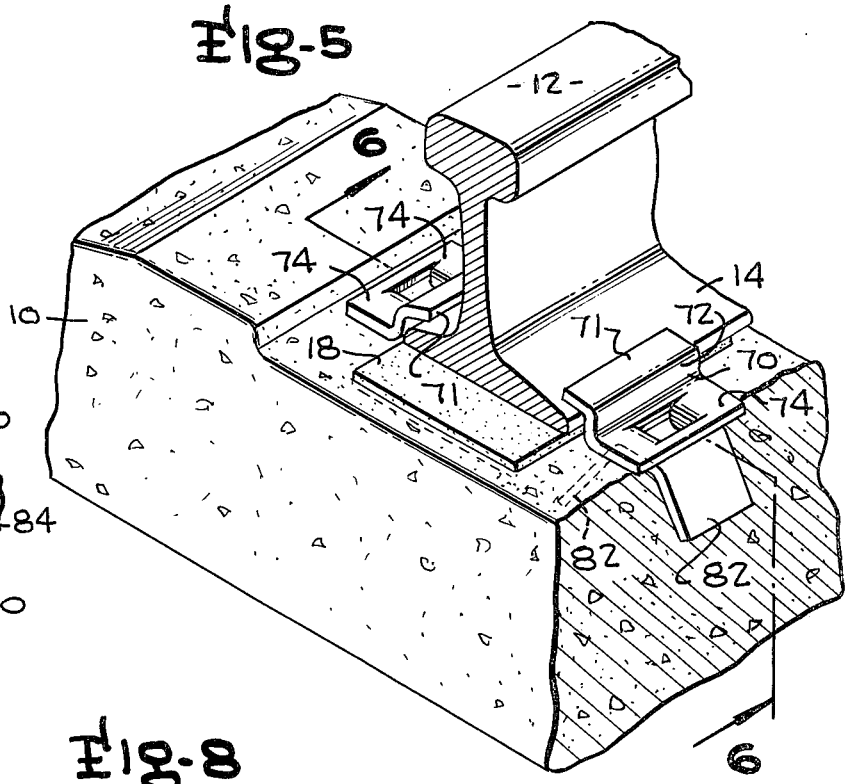
Fig-9-B
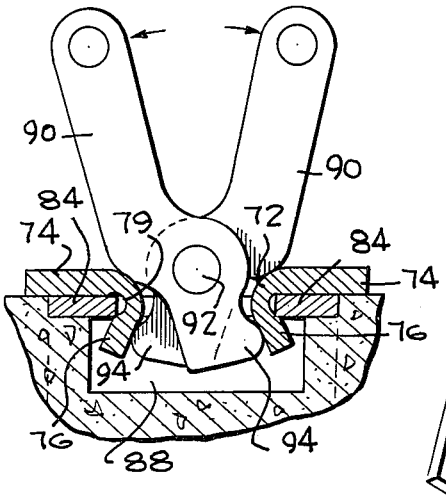
Fig-8
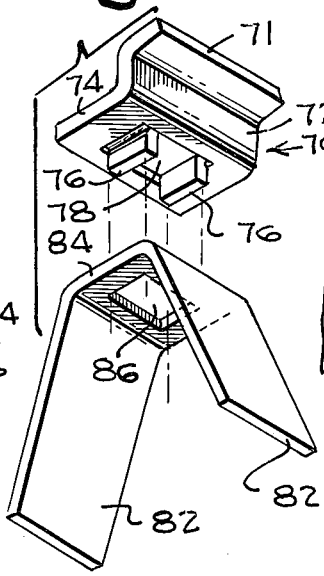
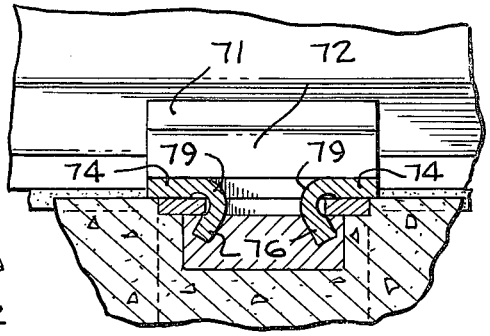
Fig-7
Fig-6
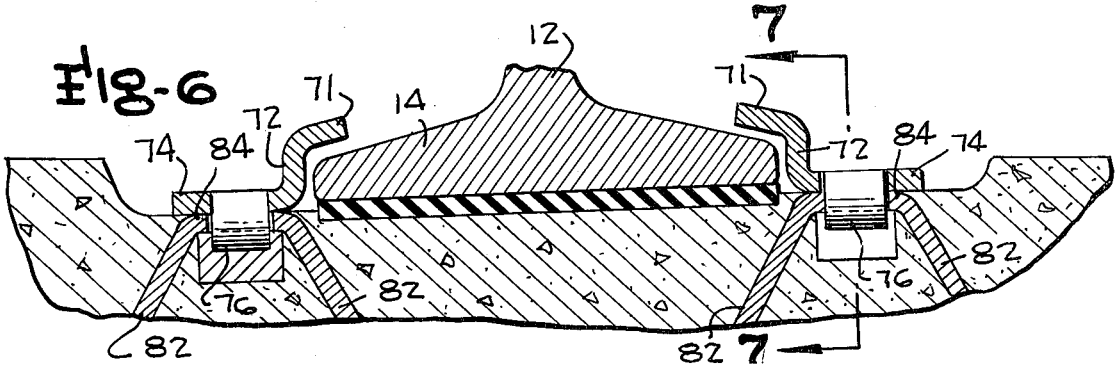

Fig-10
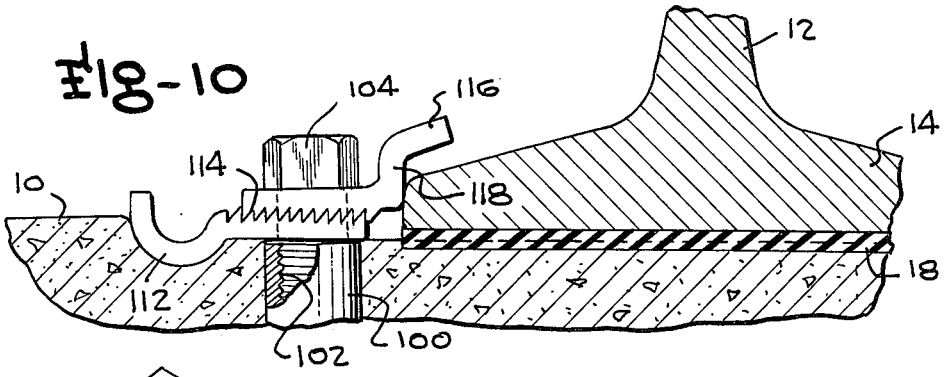
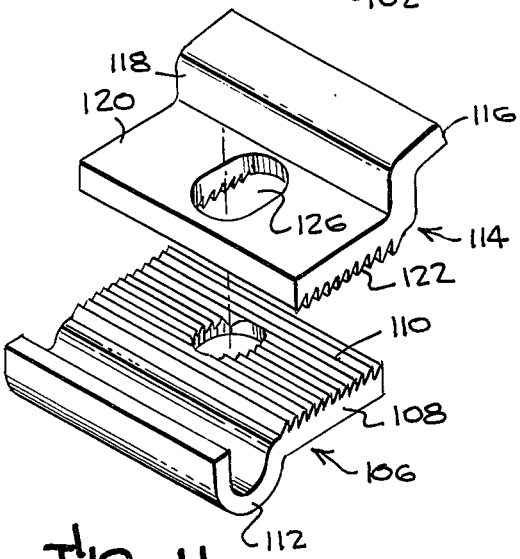
Fig-11
Fig-13
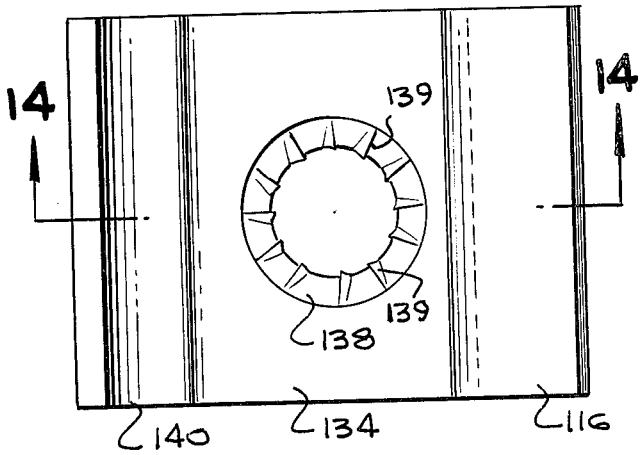
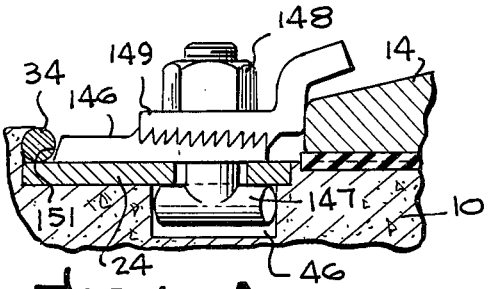
Fig-10·A
Fig-14
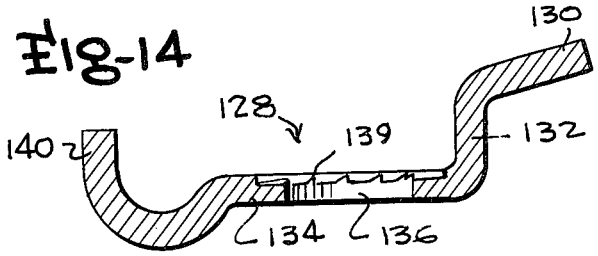
Fig-12
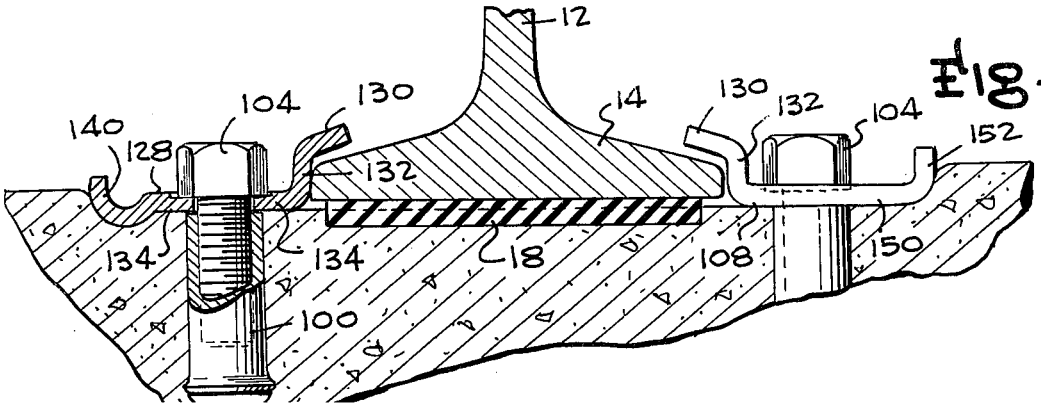

RAIL CLIP WITH DEFORMABLE ATTACHMENT LUGS

This invention is in the field of rail mounting and retaining assemblies for providing a supportive connection of a railway rail to a concrete crosstie.

Concrete crossties have gained ever increasing acceptance by the railroad industry in recent years and a wide variety of devices for mounting and connecting rail members to such concrete crossties have been proposed in the numerous patents issued in this field. The substantial number of patents which have been issued attest to the difficulty of solving the problems inherent in the mounting of rails on concrete crossties. One of the primary problems in rail systems using both concrete crossties and wooden crossties is due to the vertical movement of the rails which results in a pumping action of the tie members if the flange of the rails is immovably fixedly connected to the supporting tie. It has consequently been recognized that the rails should be permitted a degree of vertical movement within maximum limits in order to lessen the undesirable vertical crosstie movement. Other problems of the prior known rail mounting systems include lack of reliability, excessive cost in fabrication and installation.

Therefore, it is the primary object of this invention to provide a new and improved railway track mounting system.

A more specific object of the invention is the provision of a new and improved track mounting system by means of which rail members can easily be connected to concrete crossties with a minimum of labor.

Yet another object of the invention is the provision of a new and improved system for mounting rails on concrete crossties which is reliable and trouble-free and which can be fabricated and installed at a minimum cost.

Achievement of the foregoing objects is enabled by the embodiments of the invention in which gage and field base plates are respectively affixed to the upper surface of a concrete crosstie on opposite sides of the rail which rests upon a resilient pad positioned between the base plate members. The base plates are provided with an aperture which permits a connection of a gage clip and a field clip to retain the rail in position. The gage clip and field clip include a lip flange which overlies the rail flange and a foot plate which rests upon the base plate and is connected thereto. The foot plate includes deformable portions which are urged into engagement with one or more sides of the opening in the base plate and are restrained in position on the base plate following such engagement. In one embodiment, the foot plate is of V-shaped configuration having an apex positioned above the base plate and having a lock hook extending downwardly into the aperture in the base plate. Upon the application of a downward force to the apex of the foot plate, the foot plate is permanently deformed with an outer edge engaging a fixed abutment on the top surface of the base plate to forcefully urge the lock hook into engagement with an edge of the aperture in the base plate to place the foot plate in a compression stress condition between the fixed abutment and the edge of the plate so as to fixedly position the clip with respect to the base plate.

Another significant aspect of the invention resides in the provision of an anchoring means extending between the two base plates on the interior of the concrete crosstie to provide a firm anchoring of the base plate members.

In another embodiment, the deformable means on the clip comprise deformable lug means which extend downwardly through the opening in the base plate and which are bent outwardly by a special tool in an access opening beneath the base plate in the concrete crosstie so as to effect a permanent deformation of the retaining lugs to maintain the clip in position on the base plate.

Yet another aspect of the invention resides in the employment of a base plate having an upwardly facing series of sawtooth type linear serrations which engage the downwardly facing similar array of serrations on the bottom of a planar portion of a clip member. The clip member includes a flange overlying the base flange of a rail and the clip can be moved to an adjustable position and held in position by a bolt extending downwardly through apertures in the clip in the base plate to tighten the facing serrations and maintain the clip in a fixed position with respect to the base plate.

Another aspect of the invention resides in the attachment of a clip to a supporting base plate by means of a bolt extending downwardly into an anchor in the concrete crosstie. The upper face of the clip is provided with a coined area that is canted with respect to the clip in accordance with the desired rail tilt.

A better understanding of the embodiments of the invention will be achieved when the following written designation is considered in conjunction with the appended drawings in which:

FIG. 1 is a perspective view illustrating a rail member mounted on a concrete crosstie as accomplished by a first embodiment of the invention;

FIG. 2 is a sectional view taken along lines 2—2 of FIG. 1;

FIG. 3 is a sectional view taken along the same lines as FIG. 2 but illustrating one of the railway clips in a preliminary condition prior to connection to supporting means on the crosstie;

FIG. 4 is an exploded perspective view of portions of the embodiment of FIG. 1;

FIG. 5 is a perspective view of a second embodiment of the invention as mounted on a portion of a concrete crosstie;

FIG. 6 is a sectional view taken along lines 6—6 of FIG. 5;

FIG. 7 is a sectional view taken along lines 7—7 of FIG. 6;

FIG. 8 is an exploded perspective view of one of the clip members and a supporting base prior to the connection of the clip and the supporting base to form a rigid unitary assembly;

FIG. 9-A is a sectional view similar to FIG. 7 but illustrating the clip prior to connection to the supporting base by actuation of a tool member which is also illustrated;

FIG. 9-B is similar to FIG. 9-A but illustrates the next step in the process of connecting the retaining clip to the supporting base;

FIG. 10 illustrates another embodiment as mounted in a concrete crosstie;

FIG. 10-A illustrates another type of clip mounting usable with the fittings of FIGS. 1-3;

FIG. 11 is an exploded perspective view of the railway clip member and supporting base of FIG. 10;

FIG. 12 is a bisecting sectional view of another embodiment of the invention illustrating the manner of connection of rail clip means to a concrete crosstie;

FIG. 13 is a top plan view of one of the clip members of FIG. 12; and

FIG. 14 is a sectional view taken along lines 14—14 of FIG. 13.

Reference is initially made to FIG. 1 of the drawings which illustrates a concrete crosstie 10 supporting a conventional railway type rail 12 having a base flange 14. Crosstie 10 has a recess 16 in which a resilient rail supporting pad or cushion 18 formed of elastomeric material such as rubber, plastic or the like is provided to provide support for the flange 14 of the rail and to protect the crosstie from damage to rail movement in an obvious manner. Alternatively, the recess 16 can be dispensed with and pad or cushion 18 can rest upon the top surface of the crosstie if desired.

A gage clip 20 is mounted adjacent the flange 14 on the gage side of the rail 12 and a field clip 22 is mounted on the field side of the rail adjacent flange 14 in a manner best illustrated in FIG. 2. Gage clip 20 and field clip 22 are of identical construction and are respectively supported on and retained in fixed position with respect to the crosstie 10 by means of an apertured gage base plate 24 having an elongated aperture 25 and an apertured field base plate 26 having an elongated aperture 27.

A bridging anchor member is embedded in the crosstie 10 and includes longitudinal connector rods 28 of generally flattened V-shaped configuration welded on their opposite ends to the lower faces of the apertured gage base plate 24 and the apertured field base plate 26 with the longitudinal connector rods 28 having a transverse anchor rod 29 welded at their apex and being embedded in the concrete crosstie member 10 during formation of the tie. Additionally, another U-shaped side anchor member 30 is welded to the upper surface of the apertured gage base plate 24 and includes side anchor leg portions 32 joined by an abutment portion 34 which constitutes the portion of the rod member welded to the upper surface of the apertured gage base plate 24. Similarly, a U-shaped side anchor member 40 has an abutment portion 42 welded to the upper surface of the apetured field base plate 26 and side anchor leg portions 44 extending downwardly into the concrete crosstie 10.

Concrete crosstie 10 is provided with clearance recesses 46 and 48 respectively beneath the apertured gage base plate 24 and the apertured field base plate 26 and which are in alignment with the openings 25 and 27 respectively as best shown in FIG. 2. The crosstie is formed with the parts in the positions shown in FIG. 2 so that upon hardening of the concrete forming the crosstie, the connector rods 28 etc. are firmly embedded in the crosstie and the gage base plate 24, field base plate 26 and abutment portions 34 and 42 are fixedly positioned so as to be incapable of any movement.

Gage clip 20 and field clip 22 are of identical construction which will be understood from the following discussion of the gage clip 20 which consists of an upper overhanging lip flange 50 having a lower surface 51 spaced above the upper surface of the base flange 14 of the rail. A vertical side flange 52 extends downwardly from the lip flange 50 and is connected to a U-shaped foot plate 54 having a canted side edge 56. A curved lock hook 58 extends unitarily downward from the lower edge of the vertical side flange 52 in an opening 60 in the U-shaped foot plate 54. Prior to mounting on gage base plate 24, the U-shaped foot plate 54 is in the form of two generally planar components bent along an apex 62 as shown in FIGS. 3 and 4 so that the U-shaped foot plate bulges upwardly. The field clip 22 is identical to the gage clip 20 with the same components of the field clip having the same numerical designators as the corresponding components of the gage clip.

The above-discussed components are assembled by initially positioning the base flange 14 of the rail on the rail supporting pad or cushion 18 and a positioning of the rail clips in the manner illustrated in FIG. 3 with the lock hooks 58 extending downwardly through the openings 25 and 27 in the base plates 24 and 26. The clips are then struck a blow or subjected to a steady pressure as indicated by the arrow 64 in FIG. 3 by means of a heavy sledge or pressure applying means so that the U-shaped foot plates of the clips are bent about their apex 62 downwardly to provide a fixed but removable holding connection of the clip by orientation of the components of the U-shaped foot plate 54 in a horizontal plane as illustrated in FIG. 2. The deformation of the U-shaped foot plate of the gage plate 20 results in engagement of the canted side edges 56 with the abutment portion 34 of the anchor member to force the foot plate 54 downwardly with the lock hook 58 being forced beneath and in forceful engagement with the edges of aperture 25 in the apertured gage base plate 24 so that the clip 20 is locked in position. The field clip 22 is locked in position in exactly the same manner as the gage clip. Openings 46 and 48 are then filled with tar or other protective material to prevent the accumulation of water or other material in the opening which might have a corrosive effect on the clip and its mounting means. Therefore, it will be seen that the embodiment of FIGS. 1 through 4 can be rapidly assembled with a minimum of tools and effort so as to provide a rail free rail mounting as illustrated in FIG. 2 in which the rail is permitted a substantial amount of limited movement but which will be restrained from excessive movement.

Another significant aspect of the invention resides in the fact that the abutment portions 34 and 42 respectively provided on the base plates 24 and 26 provide for an accurate positioning of the clip members mounted on the base plates which is highly resistant to outward movement of the clip with respect to the rail flange 14 so as to provide a great amount of lateral stability and resistance to lateral rail movement.

FIGS. 5 through 9-B illustrate a second embodiment of the invention in which the clip members are permanently deformed to effect a fixed connection to the crosstie member. In this embodiment, the concrete crosstie 10 is provided with a downwardly extending recess in its top surface in which a rail supporting pad or cushion member 18 is provided in the same manner as the first embodiment for supporting a rail 12 having a base flange 14. Identical rail clip members 70 are attached to the crosstie on the gage and field side of the rail to provide for a limited amount of rail-free movement within controlled limits. However, the invention is not limited to use with crossties having recesses since crossties having a flat upper surface can also be employed to support cushion 18 etc.

Clip members 70 each comprise a unitary metal member having a lip flange 71 which overlies the base flange 14 of the rail with a vertical side flange 72 extending downwardly from the lip flange and merging into a foot plate 74. Foot plate 74 has two downwardly extending deformable lugs 76 between which an opening 78 is provided. It will be observed that the clips 70 have a portion of reduced thickness 79 at the juncture of lugs 76 and vertical foot plate 74; however, this feature, while desirable, is not essential to the invention.

Identical metal anchors each having side plates 82 and an upper horizontal base plate 84 are embedded in the crosstie 10 adjacent the sides of the recess in which the pad 18 is provided. Base plate 84 has a central aperture 86 of rectangular configuration which is positioned over a clearance opening 88 in the crosstie.

Prior to mounting in the anchor members 80, the clip members 70 are as shown in FIGS. 8 and 9-A with the deformable lugs 76 extending downwardly in a parallel manner. After the rail has been positioned on the pad 18, the clip members are positioned on the base plate 84 as shown in FIG. 9-A with the parallel deformable lugs 76 extending downwardly into the clearance opening 88. A spreader tool consisting of first and second levers 90 pivotally connected by pivot pin 92 is positioned so that the lower ends of levers 90 extend downwardly into the clearance opening 88. The lower ends of the levers ae provided with protrusions 94 so that movement of the upper ends of the levers 90 in the direction of the arrows in FIG. 9-B bends the deformable lugs 76 around beneath and into forceful engagement with the edges of the opening 86 in the base plate 84 with the permanent deformation of the lugs 76 providing an instantaneous and permanent attachment of the clip member to the base plate 84. Upon return of the lever members 90 to the position illustrated in FIG. 9-A, the spreader tool can be removed from the opening so as to provide the construction illustrated in FIG. 7. The opening 88 is then filled with tar or other similar protective material in the same manner as openings 46 and 48 of the first embodiment to prevent the accumulation of water or other material in the opening which might have a corrosive effect on the clip and mounting means.

FIGS. 10 and 11 illustrate another embodiment of the invention in which a concrete crosstie 10 is provided with a recess opening in which a rail pad 18 supports a rail member 12 having a base flange 14 in the manner of the previous embodiments. A tubular threaded anchor 100 is embedded in the concrete crosstie on opposite sides of the rail base flange 14, only one of which is illustrated, and includes an axial threaded bore 102 into which a locking bolt 104 having mating threads can be positioned.

A base plate 106 is positioned over anchor 100 and includes a flat portion 108 having longitudinally extending linear sawtooth type serrations 110 in its upper surface and a downwardly extending curved positioning lug section 112 along one edge. The concrete crosstie is recessed to matingly accommodate the curved positioning lug section 112 as best shown in FIG. 10.

A rail clip 114 is provided to be mounted on the longitudinally extending linear serrations 110 of the flat portion 108. It should be understood that the rail clip 114 can be either a gage clip member or a field clip member since they are identical. The clip members 114 each include an overhanging lip flange 116 and a downwardly extending vertical flange 118 unitarily joined at its lower edge to a foot plate 120. The lower face of foot plate 120 is provided with a plurality of longitudinally extending sawtooth type serrations 122 which are engaged with the mating longitudinally extending linear serrations 110 of the flat portion 108 of the base plate 106. It will be observed that the vertical portions of the serrations 122 face the vertical portions of the serrations 110 as shown in FIG. 10 so as to prevent outward movement of the clip member to the left as viewed in FIG. 10. Clip member 114 also has an elongated slot 126 of elongated configuration which permits adjustment of the position of the clip member toward or away from the base flange 14 of the rail when bolt 104 is loosened with subsequent tightening of the bolt serving to hold the clip in its adjusted position.

FIG. 10-A illustrates another embodiment of the invention employing the tie fittings and components of the embodiment of FIGS. 1 through 3 in conjunction with clip mountings employing serrated surfaces in the manner of the embodiment of FIG. 11 and a coined surface for retaining a bolt in the manner of the embodiment of FIGS. 13 etc. Specifically, the tie 10, base plate 24 and the abutment portion 34 are identical to the same elements as illustrated in FIGS. 1 through 4. An intermediate base plate 146 rests on the upper surface of base plate 24 and is provided with an aperture through which a T-head bolt 147 extends. The T-head bolt 147 is received in the clearance recess 46 but engages side walls of the recess so that it is held against rotation when a nut 148 on the upper end of the bolt is tightened. The nut 148 retains a clip member 149 in position and engages a coined surface identical to surface 138, 139 etc. of FIGS. 13 and 14 and which surround the aperture in clip 149.

It will be observed that the clip 149 and the intermediate base plate 146 have engaging serrated surfaces which engage in the same manner as surfaces 110 and 122 of the embodiment of FIGS. 10 and 11 and the clip member 149 is also provided with a slotted aperture to permit its positioning inwardly or outwardly with respect to the rail flange 14. The rear edge 151 of plate 146 is canted to engage and extend below abutment portion 34 so as to be fixed against lateral movement.

FIGS. 12 through 14 illustrate variations of the previous embodiment in which the rail clip member and base flange are combined with the resultant composite member 128 illustrated in the left portion of FIG. 12 and in FIG. 14 including an overhanging lip flange 130, a downwardly extending vertical flange 132 and a flat foot portion 134 having a central aperture 136. The upper surface of the foot portion 134 is coined in a circular surface 138 to receive the bottom face of the head of a bolt 104. The coined surface 138 includes a plurality of radial sawtooth like serrations 139 which engage the lower surface of the bolt head to prevent rotation in an unlocking direction after the bolt head has been tightened in position. The edge of the clip member 128 comprises a curved positioning lug 140 received in a mating opening in the concrete in exactly the same manner as the curved portion 112 of the previously discussed embodiment. It will be observed that the coined surface 138 is canted downwardly on the left side of the clip member in varying amounts in different clips to present a plane in which serrations 139 are provided to engage the under surface of the bolt head about its entire periphery to accommodate different degrees of rail tilt. The anchor 100 is always provided with its axis in a vertical plane and by varying the amount of tilt of the coined area 138 it is possible to accommodate various crosstie and rail configurations in which the rail tilt with respect to the axis of the tie varies over a substantial range.

The clip member 150 on the right side of FIG. 12 is identical in structure to the clip member on the left side of the rail but does not use the downwardly extending curved positioning in that the edge of the clip is simply bent upwardly at 152 as shown in the drawings. Otherwise, the clip on the right side of FIG. 12 is identical to the clip member on the left side of the same figure and the corresponding parts bear the same numerical designators.

Numerous modifications of the subject invention will undoubtedly occur to those of skill in the art. For example, it would also be possible to initially form the foot plate 54 of the first embodiment in flattened planar form with the lock hook 58 eliminated so as to simply have a central opening in the plate. The plate could then be bolted in position by a T-head bolt having its head positioned in the clearance recess 46 in the manner of the embodiment of FIG. 10-A. Similarly, a clip could be held in position by a bolt threaded into an elongated nut plate positioned in the recess 46 with the bolt head engaging the upper surface of the clip to retain same in position. Another possibility would be to use a threaded bolt having a lower hook edge engageable with the under face of the gage base plate 24 and held in hooked engagement therewith by means of a compressible slug of wood or the like engaging a canted end surface on the lower end of the bolt. The upper end of the hook bolt could be threaded to receive a nut to clamp a clip member on the upper surface of the base plate. Therefore, it should be understood that the spirit and scope of the invention is to be limited solely by the appended claims.

We claim:

1. A rail clip and mounting assembly for attaching a railway type rail having a base flange to a concrete crosstie comprising a base plate having an upper face and a lower face mounted on an upwardly facing surface of the crosstie in a position adjacent the edge of said base flange, an opening in said base plate extending downwardly into said crosstie, clip means positionable upon the upper surface of said base plate and including a lip flange overlying the upper surface of said base flange, said clip means further including deformable portions which, when subjected to a deforming force, cause movement of portions of said clip into forceful engagement with edge portions of said opening in said base plate to provide a holding connection of said clip means to said base plate, wherein said deformable portions of said clip means include a foot plate mounted immediately above said base plate, lock hook means extending downwardly from said foot plate through said opening in said base plate and wherein said deformation of said deformable portions results in movement of said lock clip toward an edge of said opening in said base plate to position a portion of said lock hook beyond said edge and beneath said base plate to prevent upward movement of said clip means from the base plate, further including abutment means on the upper surface of said base plate spaced on the other side of said opening in said base plate away from said base flange of said rail and wherein said foot plate has a side edge engageable with said abutment portion, said foot plate including an upwardly positioned portion which, when forcefully moved downward, is deformed to create a reactive force between said edge surface and said abutment portion to forcefully move said lock hook into engagement with the edge of said opening in said base plate.

2. A rail clip and mounting assembly for attaching a railway type rail having a base flange to a concrete crosstie comprising a base plate having an upper face and a lower face mounted on an upwardly facing surface of the crosstie in a position adjacent the edge of said base flange, an opening in said base plate extending downwardly into said crosstie, clip means positionable upon the upper surface of said base plate and including a lip flange overlying the upper surface of said base flange, said clip means further including deformable portions which, when subjected to a deforming force, cause movement of portions of said clip into forceful engagement with edge portions of said opening in said base plate to provide a holding connection of said clip means to said base plate, wherein said deformable portions of said clip means includes a foot plate mounted immediately above said base plate, lock hook means comprising an arcuately curved hook portion facing toward the base flange of said rail and extending downwardly from said foot plate through said opening in said base plate and defining a hook opening of a vertical breadth at its widest portion slightly greater than the vertical thickness of said base plate at a side edge portion of the opening in the base plate closest to said base flange of said rail and additionally including abutment means on the upper surface of said base plate spaced on the other side of said opening in said base plate away from said base flange of said rail, said foot plate having a side edge engageable with said abutment means, said foot plate including an upwardly positioned portion which, when forcefully moved downwardly, is deformed to create a reactive force between said edge surface and said abutment means to force said lock hook beneath and into engagement with said side edge portions of said opening in said base plate to provide an interference fit of the hook and the base plate to tightly and forcefully engage the clip with the base plate.

3. The invention of claim 2, wherein said abutment means comprises a rod member welded to the upper surface of said base plate and having side anchor leg portions extending unitarily from said rod member into said concrete crosstie.

4. A rail clip and mounting assembly for attaching a railway type rail having a base flange to a concrete crosstie comprising a base plate having an upper face and a lower face mounted on an upwardly facing surface of the crosstie in a position adjacent the edge of said base flange, an opening in said base plate extending downwardly into said crosstie, clip means positionable upon the upper surface of said base plate and including a lip flange overlying the upper surface of said base flange, sail clip means further including deformable portions which, when subjected to a deforming force, cause movement of portions of said clip into forceful engagement with edge portions of said opening in said base plate to provide a holding connection of said clip means to said base plate, wherein said clip means comprises a foot plate, an opening in said foot plate, said deformable means comprising first and second deformable lugs extending downwardly along opposite side edges of said opening in said foot plate, said deformable lugs being dimensioned to extend below said foot plate through the opening in said base plate into the clearance recess in said crosstie whereby a tool can be inserted into said recess to spread the lower ends of said deformable lugs apart with respect to each other to engage said edges of said opening in said base plate and provide a holding connection of said clip to said base plate.

5. The invention of claim 4 additionally including first and second downwardly extending plates unitarily extending from said base plate embedded in said concrete crosstie.

6. A rail clip and mounting assembly for attaching a railway type rail having a base flange to a concrete crosstie comprising a base plate having an upper face and a lower face mounted on an upwardly facing surface of the crosstie in a position adjacent the edge of said base flange, an opening in said base plate extending downwardly into said crosstie, clip means positionable upon the upper surface of said base plate and including a lip flange overlying the upper surface of said base flange, said clip means further including deformable portions which, when subjected to a deforming force, cause movement of portions of said clip into forceful engagement with edge portions of said opening in said base plate to provide a holding connection of said clip means to said base plate, wherein said deformable portions of said clip means include a foot plate which prior to mounting on said base plate is of inverted V-shape extending upwardly immediately above said base plate, lock hook means extending downwardly from said foot plate through said opening in said base plate, said opening in said base plate having a linear edge closest to said base flange, abutment means on the upper surface of said base plate spaced on the other side of said opening in said base plate away from said base flange of said rail and wherein said foot plate has a side edge engageable with said abutment portion, whereby the application of downward force to said inverted V-shaped foot plate results in a flattening of said foot plate to create a reactive force between said edge surface and said abutment to forcefully engage said lock hook with the linear edge of said opening in said base plate so that a portion of said lock hook moves beneath said base plate to prevent upward movement of said clip means from the base plate.

7. The invention of claim 6 wherein said abutment means comprises a rod member welded to the upper surface of said base plate and having side anchor leg portions extending unitarily from said rod member into said concrete crosstie.

8. A rail clip and mounting assembly for attaching a railway type rail having a base flange to a concrete crosstie comprising a base plate having an upper face and a lower face mounted on an upwardly facing surface of the crosstie in a position adjacent the edge of said base flange, an opening in said base plate extending downwardly into said crosstie, clip means positionable upon the upper surface of said base plate and including a lip flange overlying the upper surface of said base flange, said clip means further including deformable portions which, when subjected to a deforming force, cause movement of portions of said clip into forceful engagement with edge portions of said opening in said base plate to provide a holding connection of said clip means to said base plate, wherein said deformable portions of said clip means comprises a foot plate of inverted flattened V-shape as viewed from a side edge along a line of sight parallel to the axis of said rail and lock hook means extending downwardly from said clip plate through said opening in said base plate defining a hook opening facing an edge of the opening in said base plate closest to said rail whereby downward deformation of said inverted V-shaped foot plate moves said hook opening into forceful engagement with the edge of the base plate adjacent the edge of the opening in said base plate.

* * * * *